US011052276B1

(12) United States Patent
Baker

(10) Patent No.: US 11,052,276 B1
(45) Date of Patent: Jul. 6, 2021

(54) WEIGHT PLATE AND BARBELL COMPONENT SYSTEM

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 129 days.

(21) Appl. No.: 16/017,109

(22) Filed: Jun. 25, 2018

Related U.S. Application Data

(63) Continuation-in-part of application No. 15/964,539, filed on Apr. 27, 2018, now abandoned.

(60) Provisional application No. 62/491,247, filed on Apr. 27, 2017.

(51) Int. Cl.
*A63B 21/072* (2006.01)
*A63B 21/06* (2006.01)
*A63B 71/00* (2006.01)

(52) U.S. Cl.
CPC ..... *A63B 21/0728* (2013.01); *A63B 21/0604* (2013.01); *A63B 21/0724* (2013.01); *A63B 71/0036* (2013.01)

(58) Field of Classification Search
CPC ..... A63B 21/0601; A63B 21/063; A63B 21/0632; A63B 21/072–0783; A63B 21/0728; A63B 71/0036; A63B 21/0604; A63B 21/0724; A63B 21/075
See application file for complete search history.

(56) References Cited

U.S. PATENT DOCUMENTS 1,779,594 A * 10/1930 Hall ..... A63B 21/0728 482/107
4,738,446 A * 4/1988 Miles ..... A63B 21/0728 24/580.11
5,024,434 A * 6/1991 Smith ..... A63B 21/0724 482/106
5,062,631 A * 11/1991 Dau ..... A63B 21/0728 403/330
5,344,375 A * 9/1994 Cooper ..... A63B 21/0728 482/106
5,484,367 A * 1/1996 Martinez ..... A63B 21/0728 482/107
5,853,355 A * 12/1998 Standish ..... A63B 21/0601 482/106
6,319,176 B1 * 11/2001 Landfair ..... A63B 21/06 482/106

(Continued)

FOREIGN PATENT DOCUMENTS

KR 101115444 B1 * 2/2012

OTHER PUBLICATIONS

KR-101115444-B1 Machine Translation Mar. 20, 2020 (Year: 2020).*

*Primary Examiner* — Nyca T Nguyen

(57) ABSTRACT

A barbell comprises a substantially cylindrical elongated bar having a plurality of connectors located along the length thereof. A generally disk shaped weight plate having a central aperture and a peripheral handle is provided, and the barbell is received within the central aperture. A fastening assembly is formed on the weight plate and extends between the central aperture and the peripheral handle. The fastening assembly is selectively movable between a first position in which it engages with one of the connectors on the barbell, and a second position in which it is disengaged from the connector on the barbell.

14 Claims, 18 Drawing Sheets

(56) References Cited

U.S. PATENT DOCUMENTS 6,736,765 B2 * 5/2004 Wallace ..... A63B 21/072 482/106
7,172,536 B2 * 2/2007 Liu ..... A63B 21/0728 482/108
7,731,641 B1 * 6/2010 Chen ..... A63B 21/075 482/106
7,828,702 B2 * 11/2010 Lien ..... A63B 21/0724 482/106
9,950,205 B2 * 4/2018 Simonetti ..... A63B 21/063
10,478,657 B1 * 11/2019 Demo ..... A63B 21/0722
2002/0022559 A1 * 2/2002 Krull ..... A63B 21/0728 482/106
2002/0091044 A1 * 7/2002 Lien ..... A63B 21/06 482/106
2002/0107118 A1 * 8/2002 Shifferaw ..... A63B 21/0728 482/106
2003/0083179 A1 * 5/2003 Landfair ..... A63B 21/06 482/93
2003/0125169 A1 * 7/2003 Burwell ..... A63B 21/0728 482/106
2004/0092370 A1 * 5/2004 Lincir ..... A63B 21/072 482/107
2004/0166997 A1 * 8/2004 Vigiano ..... A63B 21/06 482/93
2005/0192167 A1 * 9/2005 Shifferaw ..... A63B 21/0615 482/94
2006/0003874 A1 * 1/2006 Hamilton ..... A63B 21/06 482/93
2006/0172070 A1 * 8/2006 Cao ..... B41M 7/0027 427/258
2006/0217244 A1 * 9/2006 Hudson ..... A63B 21/0728 482/93
2007/0135271 A1 * 6/2007 Lien ..... A63B 21/0724 482/93
2007/0173386 A1 * 7/2007 Wang ..... A63B 21/0728 482/107
2009/0048079 A1 * 2/2009 Nalley ..... A63B 21/0728 482/107
2009/0239719 A1 * 9/2009 Patti ..... A63B 21/0726 482/107
2010/0248913 A1 * 9/2010 Dickerson ..... A63B 21/0615 482/104
2010/0304939 A1 * 12/2010 Svenberg ..... A63B 21/0728 482/108
2011/0045956 A1 * 2/2011 Colledge ..... A63B 21/0728 482/107
2011/0245048 A1 * 10/2011 Nalley ..... A63B 21/0615 482/107
2012/0021877 A1 * 1/2012 Lundquist ..... A63B 21/0728 482/107
2012/0220434 A1 * 8/2012 Lien ..... A63B 21/0726 482/108
2014/0162855 A1 * 6/2014 Beckman ..... A63B 21/0728 482/139
2015/0231441 A1 * 8/2015 Davies, III ..... A63B 21/15 482/107
2016/0151658 A1 * 6/2016 Nalley ..... A63B 21/063 482/107
2016/0228739 A1 * 8/2016 Wu ..... A63B 21/0728
2017/0189735 A1 * 7/2017 Buikema ..... A63B 21/4035
2017/0259103 A1 * 9/2017 Simonetti ..... A63B 21/063
2018/0200563 A1 * 7/2018 Hansen ..... F16B 2/10
2018/0272175 A1 * 9/2018 Henniger ..... A63B 21/0726
2019/0232100 A1 * 8/2019 Rothschild ..... A63B 21/0604
2019/0299047 A1 * 10/2019 Nalley ..... A63B 21/075
2019/0366142 A1 * 12/2019 Dale ..... A63B 15/00

* cited by examiner

WEIGHT PLATE AND BARBELL COMPONENT SYSTEM

CROSS-REFERENCE TO RELATED APPLICATIONS

This application is a continuation in part application of U.S. patent application Ser. No. 15/964,539 filed Apr. 27, 2018, which claims the benefit of U.S. Provisional Patent Application No. 62/491,247 filed Apr. 27, 2017, the contents of which are incorporated herein by reference in their entirety.

FIELD AND BACKGROUND OF THE INVENTION

Exercise has been strongly in the public arena for the better part of the last 70 years, from Jack LaLanne to Arnold Schwarzenegger and beyond. The fitness industry has boomed and grown substantially over the years, and there are gyms which come in every size and shape, from single location gyms to chains that have over a thousand locations. While the items available for "working out" have changed many times over, there are still a few pieces of exercise equipment that are constant and that endure.

One of the best examples of an enduring workout item would be in the area of free weights, those being the weight plates that come in different sizes and weights, and the over-sized bars that those plates slide onto. While the exterior shape of these plates may have changed from round to octagonal to hexagonal, and from raw iron to rubber coated iron, they all require an external clamping mechanism to secure the weight plate to the bar, thus keeping the weight plate from slowly moving axially along the bar in case the user may be less than balanced from side to side in their usage of the barbell and weight plates.

There are several types of clamps available today, one of the most common being a simple coiled spring and clamp arrangement which the user simply squeezes to increase the interior diameter of an opening for receiving the bar, thereby allowing the user to slide the clamp over the bar. The subsequent release of the pressure then permits the clamp to squeeze the bar, hence maintaining the location of the weight plate on the barbell.

Just about every other clamp type has some sort of squeeze or lever lock or the like. They all have one additional thing in common, namely, that they comprise a separate or discrete device that often resides or is stored other than where they are needed thus requiring the user to locate a pair of clamps and then apply them after installing the weight plates on the barbell. Many times at larger gym locations, there just are not enough clamps available and users may thus workout with these heavy weight plates without the required securing clamps. This may obviously increase the amount of safety concerns by the user, and may also raise the level of liability for the facility.

There is thus a need for a weight plate that contains its own internal or self-contained clamping and locking mechanism, not only for a safer connection between barbell and weight plate, but also for increase safety, increased security, and decreased liability.

SUMMARY OF THE INVENTION

According to one aspect of the invention, there is provided a barbell comprising: a substantially elongated cylindrical barbell having a plurality of connectors located along the length thereof; a generally disk shaped weight plate having a central aperture and peripheral handles, the barbell being received within the central aperture; and a fastening assembly formed on the weight plate and extending between the central aperture and one of the plurality of peripheral handles, the fastening assembly being selectively movable between a first position in which it engages with one of the connectors on the barbell, and a second position in which it is disengaged from the connector on the barbell.

Preferably, the connectors on the barbell comprise a plurality of spaced grooves formed on the barbell, and at least one of the grooves formed on the barbell further comprises an alignment lock groove therein, each lock groove and alignment lock groove in combination restricting both axial and rotational movement of the weight plate relative to the barbell.

In one embodiment, the fastening assembly comprises a pull lever formed in the hand hold access area of one of the peripheral handle areas, a lock plate located at the central aperture, and a pull rod extending between the pull lever and the lock plate, wherein down and up movement of the pull lever moves the lock plate between the first position in which it engages with the connector and the second position in which the lock plate is disengaged from the connector on the barbell. A lock assembly case may be fixed relative to the weight plate, the lock assembly case accommodating and supporting the pull rod tube and pull rod which attaches the lock plate to the pull lever which is movable relative thereto in response to the pull lever.

In one aspect, the lock plate comprises an arced contact surface, the barbell comprises a circumferential lock groove and an alignment lock groove formed within the circumferential lock groove, the arced contact surface being releasably accommodated within the alignment lock groove.

A plurality of weight plates may be selectively mounted on the barbell.

In a further embodiment, the fastening assembly includes an alignment pin, the barbell comprises a circumferential lock groove including at least one alignment pinhole formed within the circumferential groove, the alignment pin on the fastening assembly being selectively receivable within the pinhole to secure the weight plate to the barbell in a manner which prevents axial and rotational movement of the weight plate relative to the barbell. The circumferential lock groove addresses securement of the axial movement and the alignment pinhole addresses securement of the rotational movement of the weight plate.

According to another aspect of the invention, there is provided weightlifting apparatus comprising: a barbell having a plurality of connectors located along the length thereof; a weight plate having an aperture therein and a handles formed near the periphery thereof, the barbell being received within the aperture; a fastener formed on the weight plate assembly between the aperture and the handle, the fastener being selectively movable between a first position in which it engages with a connector on the weight bar, and a second position in which it is disengaged from the connector on the barbell; and biasing means for urging the fastener into the first position.

Preferably, the barbell is of elongate cylindrical shape, with a plurality of connectors located near each end thereof, the connectors comprising a series of spaced circumferential grooves and at least one alignment groove formed within the circumferential groove. The weight plate may be disk shaped, with the aperture being at the center thereof, and the handles comprising a recessed area near the periphery thereof.

In one embodiment, the fastener comprises a pull lever residing in the handle recess area, a lock plate near the aperture, and a pull rod between the pull lever and the lock plate, the lock plate being moved between the first position and the second position by operating the pull lever.

According to yet a further aspect of the invention, there is provided a method of securing a weight plate to a barbell of a weightlifting apparatus, the method comprising: providing a cylindrical bar having a plurality of connectors at each end thereof; providing a weight plate of generally circular shape and having a central aperture, and sliding the cylindrical bar into the aperture; and securing a fastener to the weight plate such that the fastener can operate between a first closed position in which it engages a connector on the cylindrical barbell, and a second open position in which it is disengaged from the connector on the cylindrical barbell.

The present invention, which may be referred to as the "Interlok", is a weight plate system that incorporates an internal locking device inside or on the weight plate itself. In one aspect, the present invention is for a barbell or weightlifting apparatus, including a weight support bar, and one or more weight plates which may be selectively placed on the weight support bar. The system may be made complete with the addition of the weight bar specifically designed to allow for engagement with each plate internal locking system.

The barbell or weightlifting apparatus of the invention may have, in one preferred aspect, a built in fastening system whereby the weight support bar and weight plates are suitably connected to each other in a releasable manner. Connection is facilitated by structures which are part of the weight plate, thereby requiring no external tools or hardware in order to make the connection, or release and disengage the weight plate from the weight support bar.

This system allows for time saving by not having to look for clamps, cost savings by not losing or having clamps removed from the location, increased safety in that users must engage the locking system to be able to even put the weight plate on the barbell, and additional financial savings for facilities with potentially lower liability as a result of the features noted above.

DETAILED DESCRIPTION OF THE INVENTION

Figure 1:
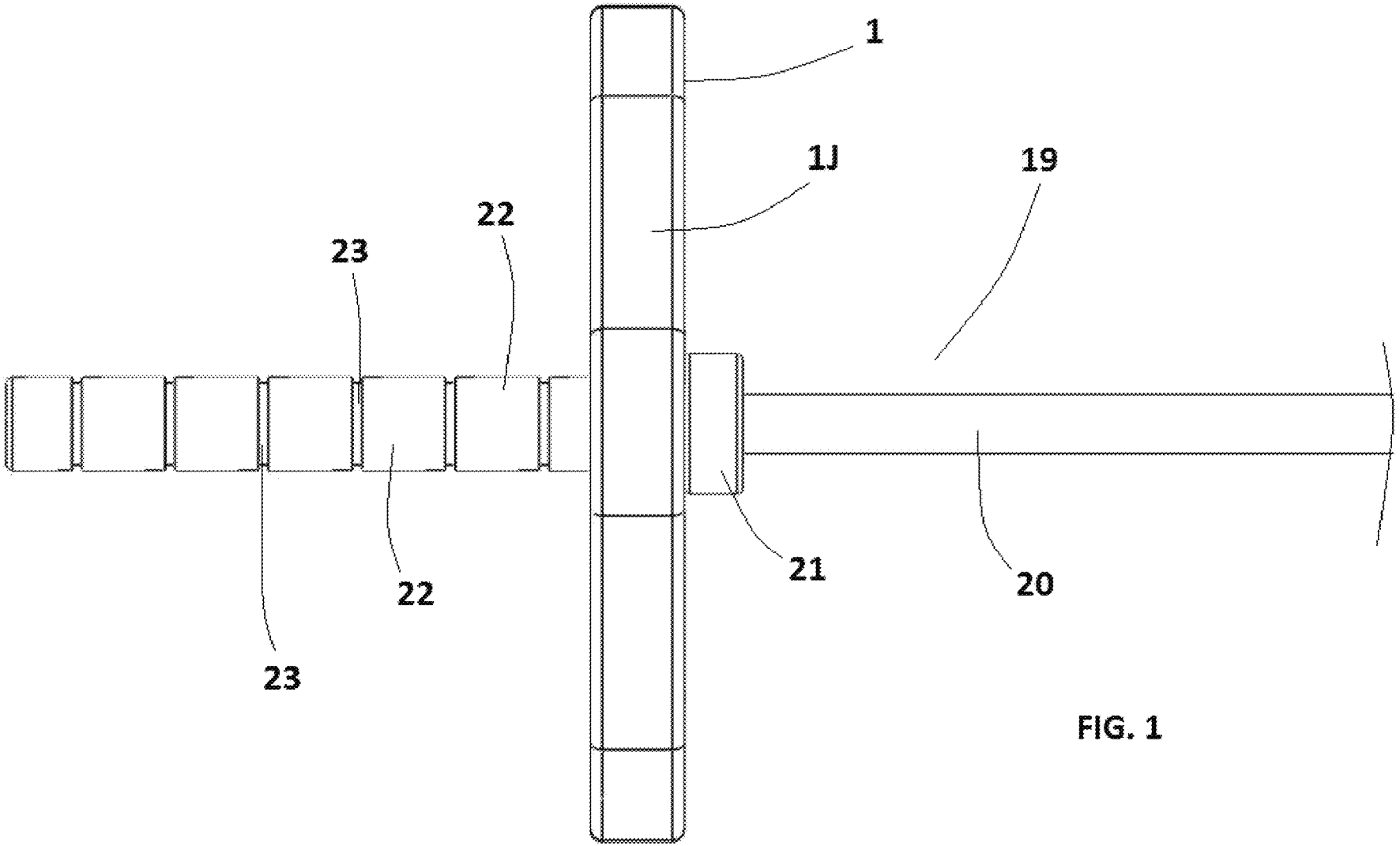
FIG. 1 is a side view of a weight plate and barbell in accordance with one aspect of the invention.

Reference is now made to the accompanying drawings which show the features and different embodiments of a weight plate constructed and configured in accordance with the present invention.

The figures illustrate a weight plate 1 having weight plate outer edge 1J, which may be releasably fastened and removed from a barbell 19. The weight plate 1 comprises a lock assembly case 2, and a pull rod casing 3. Further, the weight plate 1 comprises a pair of handles 4, which are preferably, but not necessarily, on opposing sides of the weight plate 1, the handles 4 typically being located within or defining a hand space 5. A release and lock pull lever 6 is located within a hand space 5. A pull rod 7 is fastened to the release and lock pull lever 6, and is accommodated over substantial part of the length within a pull rod tube 8.

Figure 5:
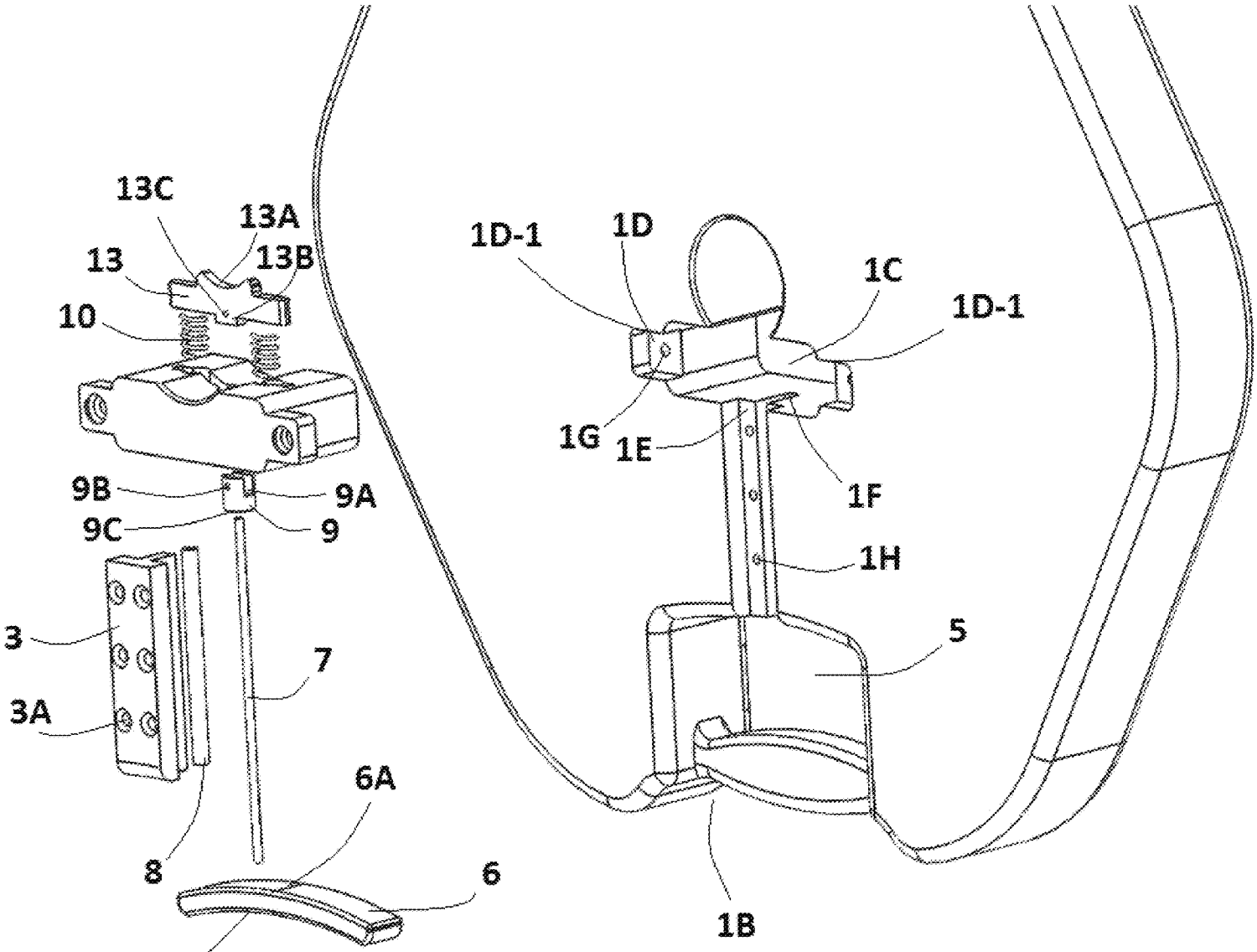
FIG. 5 is an exploded view showing the various parts and structure of a weight plate in accordance with the invention.

The weight plate 1 further comprises a lock plate plug 9 (clearly seen in FIG. 5 of the drawings), and a lock plate 13 which engages with the barbell 19, as will be discussed in further detail below. Springs 10, seen in several of the figures including FIGS. 4, 5, 6 and 7, bias the lock plate 13 urging it into engagement with the barbell 19, also to be discussed in further detail below.

Figure 2:
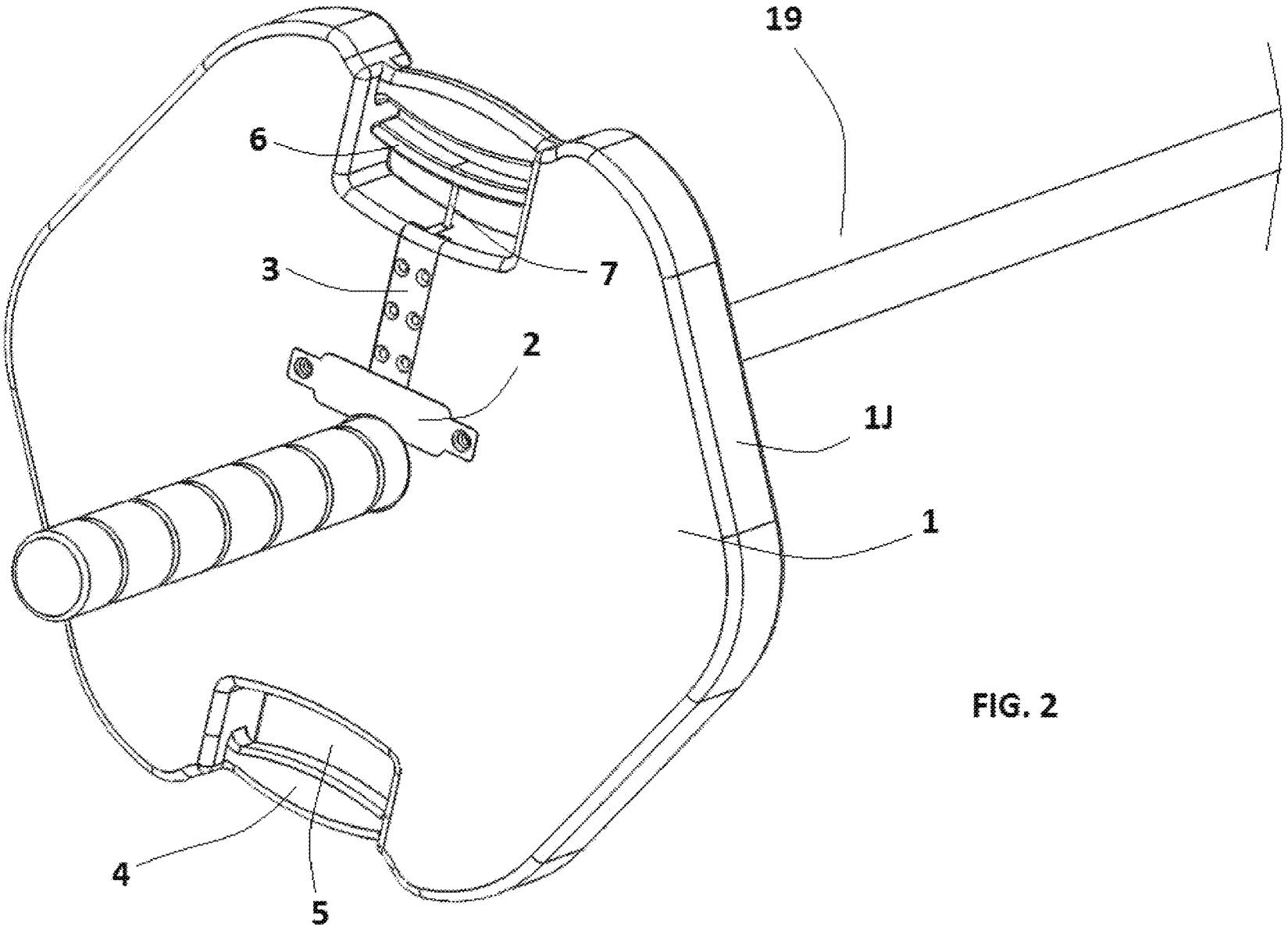
FIG. 2 is a perspective view of a weight plate and barbell shown in FIG. 1 of the drawings.

As will be seen in the drawings, particularly FIGS. 1 and 2, the barbell 19 has a barbell center section 20. The barbell 19 includes a weight plate holding area 22, which includes a plurality of preferably spaced or equi-spaced barbell general lock grooves 23. A barbell internal collar stop 21 is provided. Further, each of the barbell general lock grooves 23 includes at least one direct alignment lock groove 24, best seen in FIG. 7 of the drawings.

In operation, the weight plate 1 can be releasably attached to and removed from the barbell 19. The lock plate 13 can be selectively moved in and out of the barbell general lock groove 23, and is received within the direct alignment lock groove 24. When so fastened, the weight plate 1 will not be able to move axially along the barbell 19, nor will it be able to rotate about the barbell 19 due to the connection effected when the lock plate 13 is received within the direct alignment lock groove 24.

Details relating to the various components recited above, and their preferred structure, will now be described.

The weight plate 1 comprises a center mounting barbell hole 1A, and a hand placement outer recessed area 1B. The figures illustrate the lock assembly mounting area 1C, and a lock assembly mounting tab area 1D. This includes a lock plate secondary stop surface 1D-1. There is further provided a pull rod casing mounting area 1E and a pull rod tube mounting area 1F (clearly seen in FIG. 5 of the drawings.) Further, there are provided lock assembly fastening holes 1G and pull rod casing fastening holes 1H, also seen in FIG. 5 of the drawings.

The lock assembly case 2 comprises lock assembly case bolt holes 2A by means of which the lock assembly case 2 is bolted to the weight plate 1. Further, the lock assembly case 2 is configured so as to comprise a lock assembly barbell clearance arc 2B which is designed to receive the barbell 19. A lock assembly spring pocket 2C is provided to house the springs 10. Further, a lock assembly lock plate slot 2D is provided to receive a portion of the lock plate 13, which itself will be discussed in further detail below. There is also a lower contact stop pad 2E formed on the lock assembly lock plate slot 2D.

The pull rod casing 3 includes pull rod casing bolt holes 3A to facilitate attachment of the pull rod casing 3 to the weight plate 1. Further, there is formed pull rod casing end surfaces 3B which abuts the hand space area 5 on one end and abuts the lock assembly case 2 on the other end. The pull rod casing 3 also includes the pull rod case center extension mount 3C, extending into the weight plate 1, and having an arcuate pull rod case mounting surface 3D which is configured to receive and provide support for the pull rod tube 8.

Figure 3:
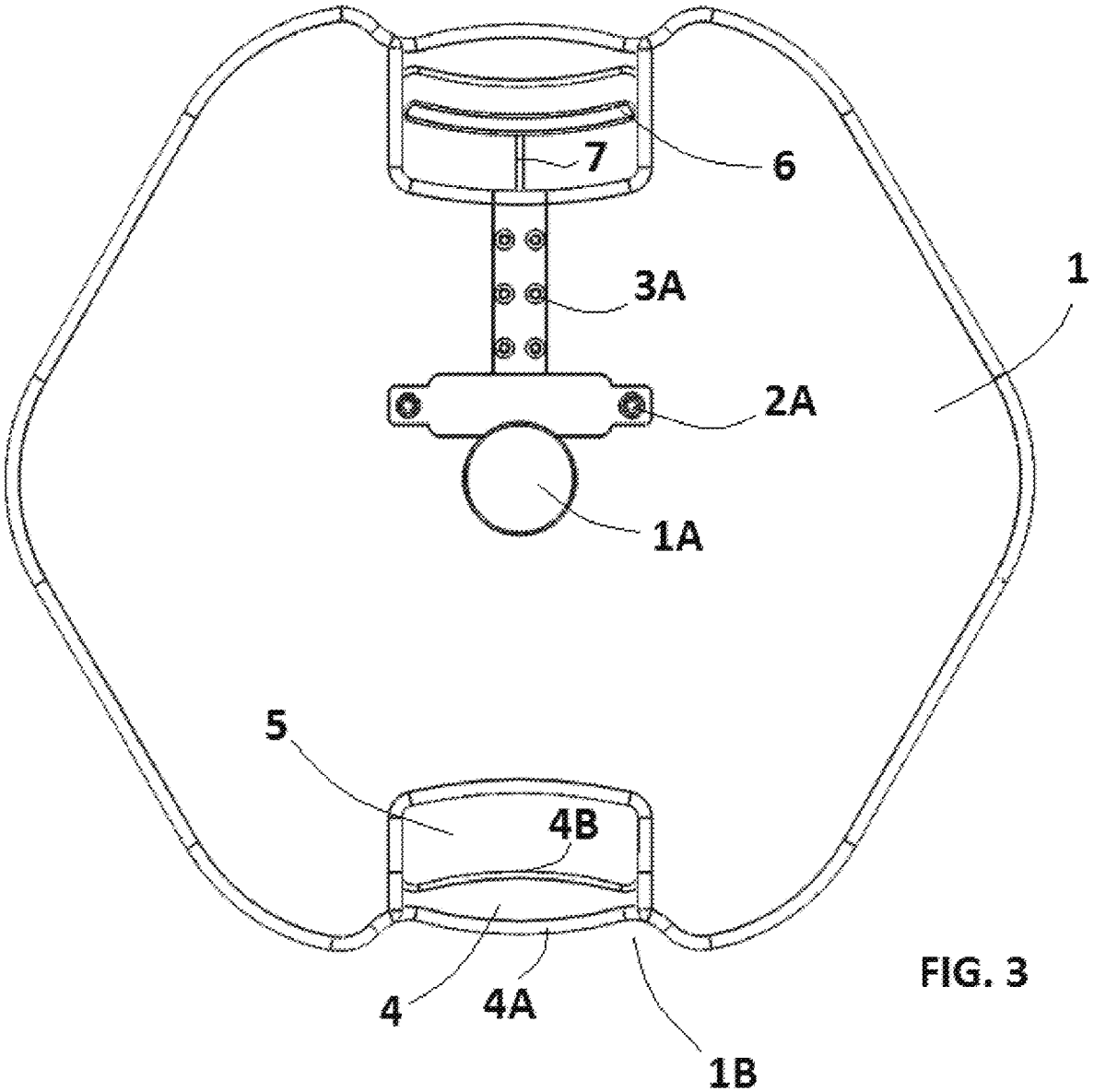
FIG. 3 is a front view of the weight plate shown in FIG. 2 of the drawings.
Figure 4:
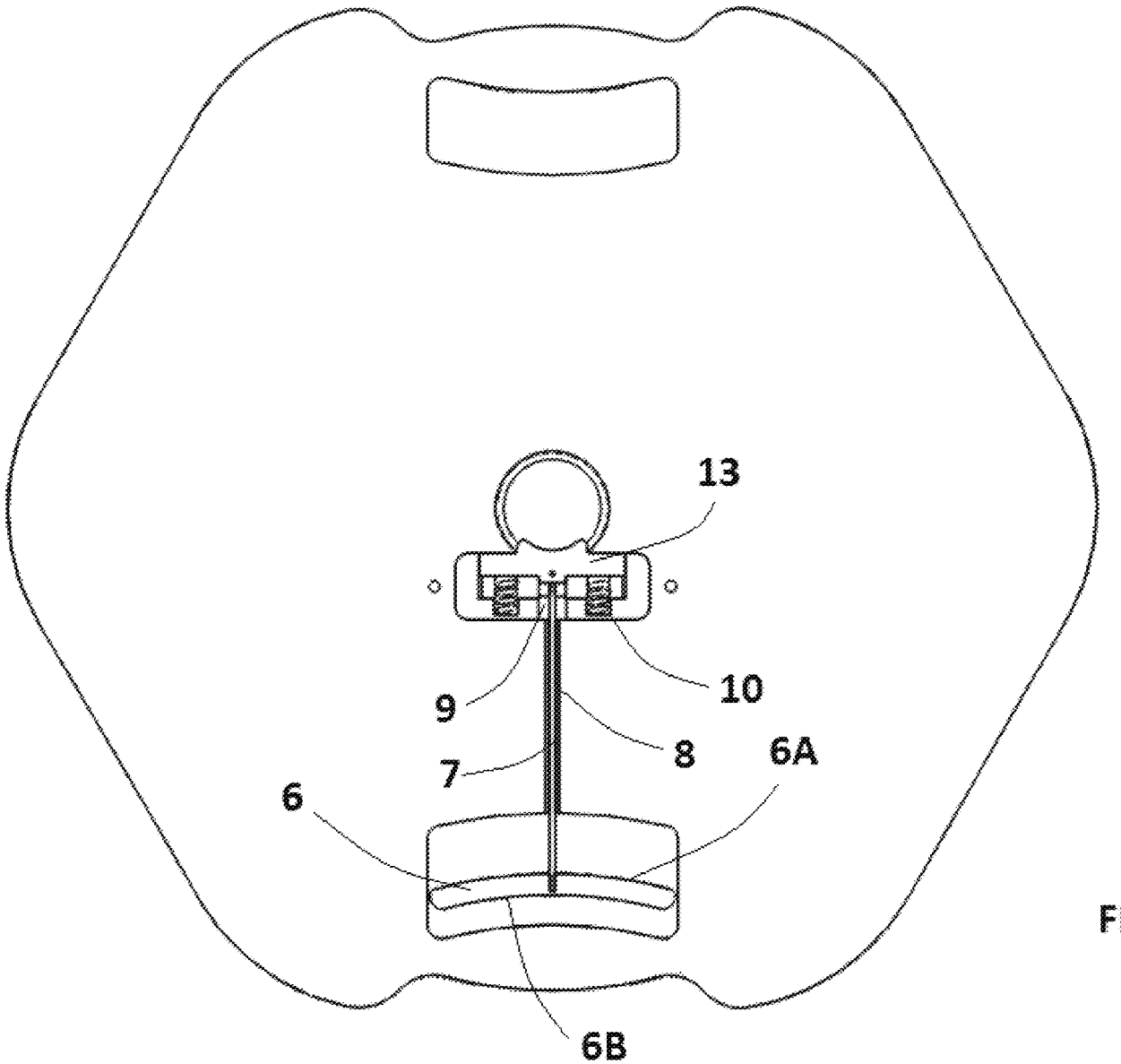
FIG. 4 is a front schematic view of a weight plate showing the parts and components of the mechanism for fastening the weight plates to a barbell.

One or more handles 4, preferably two on substantially opposing sides of the weight plate 1, are formed within the weight plate 1. A handle 4 preferably comprises the exterior handhold surface 4A and an interior handhold surface 4B, as best seen in FIG. 3 of the drawings. The hand space 5 includes the hand with space relief 5B, as well as the handle with combination space relief 5C.

The release and lock pull lever 6 comprises the release and lock lever attachment hole 6A, by means of which it may be attached to the pull rod 7, and a release and lock lever outer surface 6B. The pull rod 7 itself includes threaded mounting ends 7A, by means of which it is attached to the lock plate plug 9 and the pull lever 6. The pull rod 7 therefore extends between the lock plate plug 9 and the release and lock pull lever 6. As such, any up and down movement of the lock plate 13 accommodated in the lock assembly case 2 will result in the axial movement of the pull rod 7, and the concomitant up and down movement of the release and lock pull lever 6. In other words, the pull lever 6, when moved up and down, moves the lock plate 13 in the lock assembly case 2 up and down as well, which, as will be described more fully below, facilitates engagement between the lock plate 13 mounted in the lock assembly case 2, and a lock groove 23 in the barbell 19.

Figure 6:
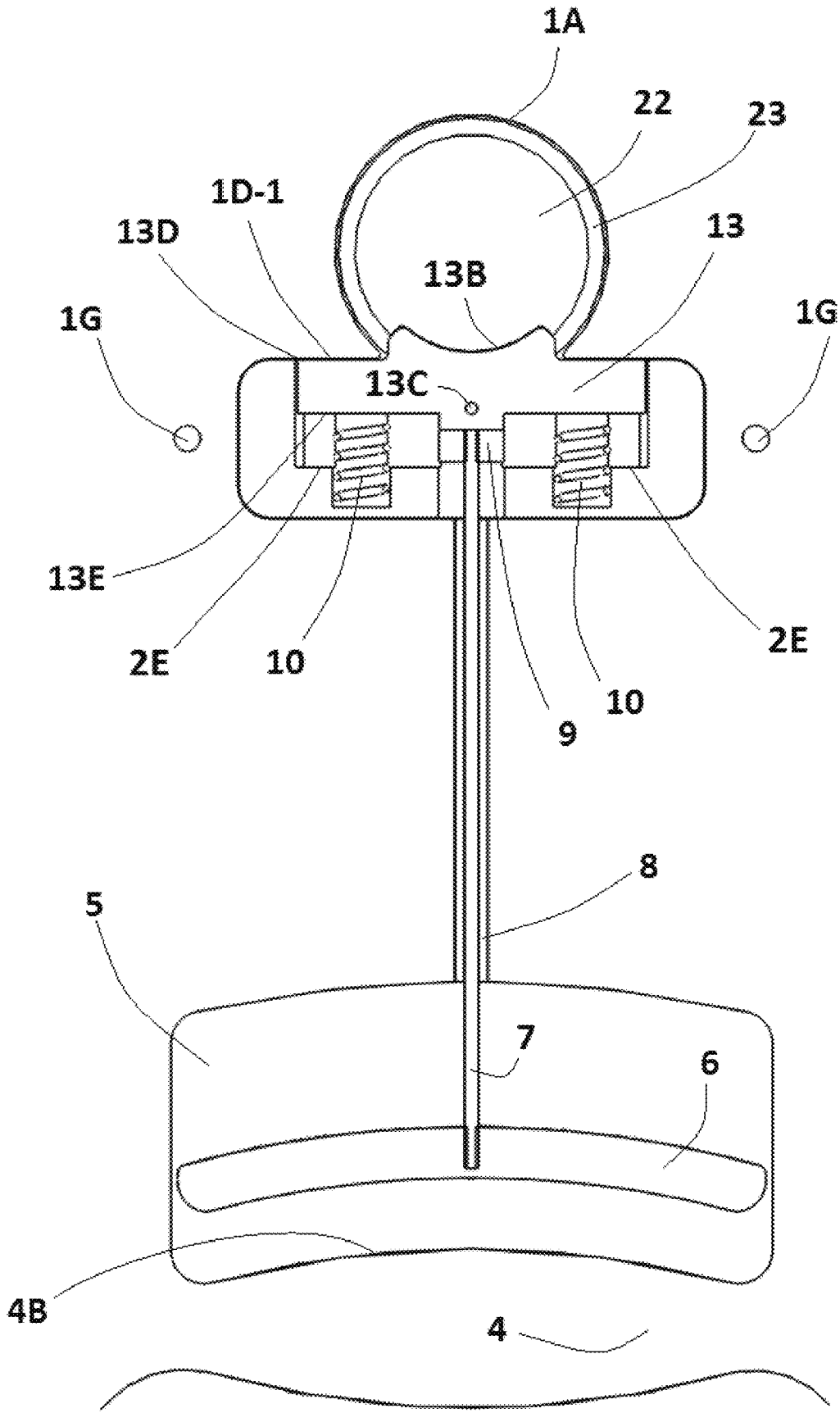
FIG. 6 is a detailed view of the release and lock pull lever opening and closing mechanism utilized in a weight plate of the present invention in its locked position with the lock plate engaged in the circumferential lock groove and the alignment groove.

The pull rod 7 is supported by a pull rod tube 8, clearly seen in FIG. 6 of the drawings, the pull rod tube 8 extending the distance between the lock assembly case 2 and the hand space 5 at its edge closest to the center aperture of the weight plate. The pull rod 7 is longer than the pull rod tube 8, its ends attaching to the lock plate 13 in the lock assembly case 2 and the pull lever 6, as shown in the drawings.

Figure 7:
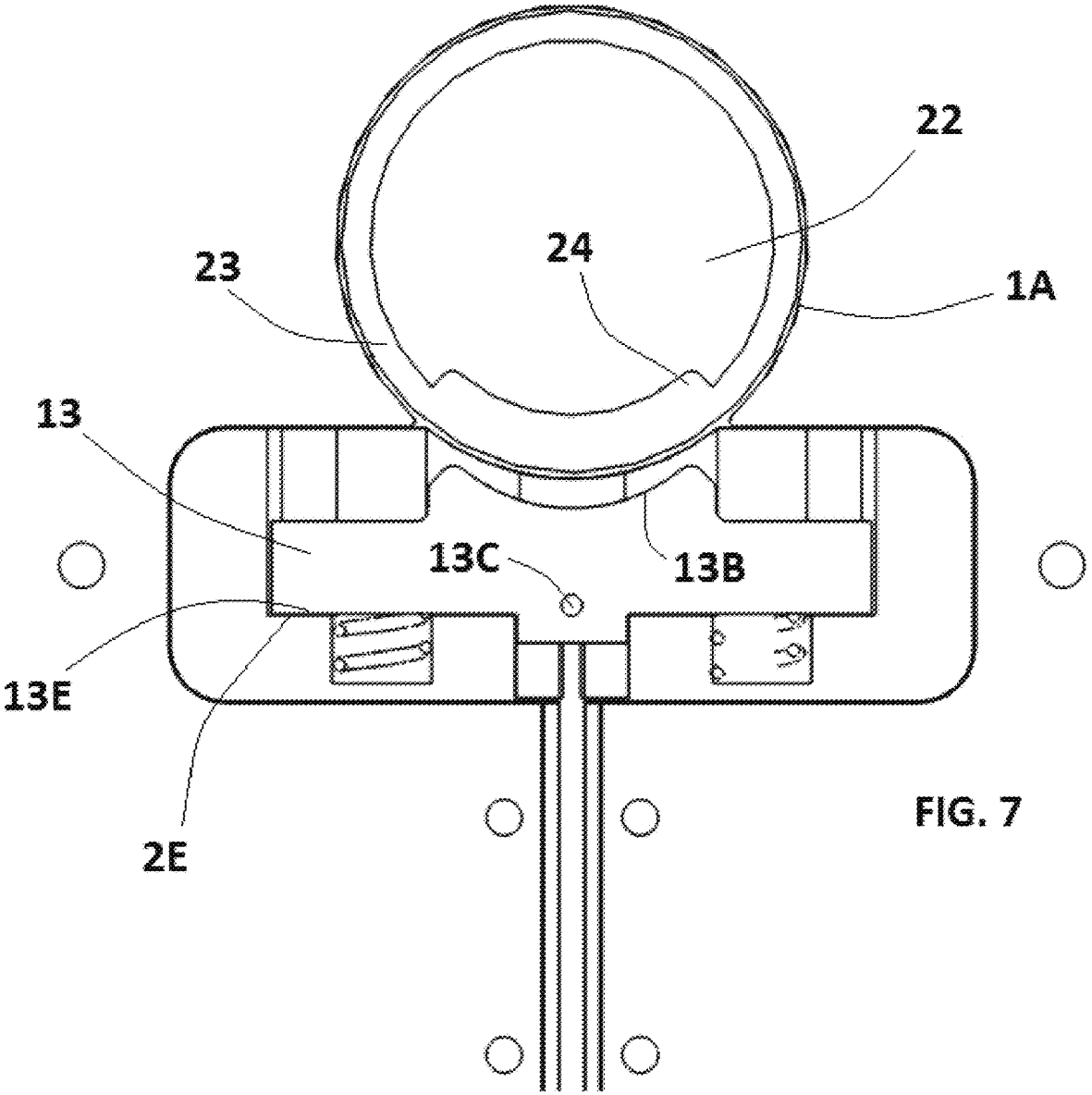
FIG. 7 is a detailed view of the release and lock pull lever opening and closing mechanism utilized in a weight plate of the present invention in its unlocked position with the lock plate disengaged in the circumferential lock groove and the alignment groove.
Figure 8:
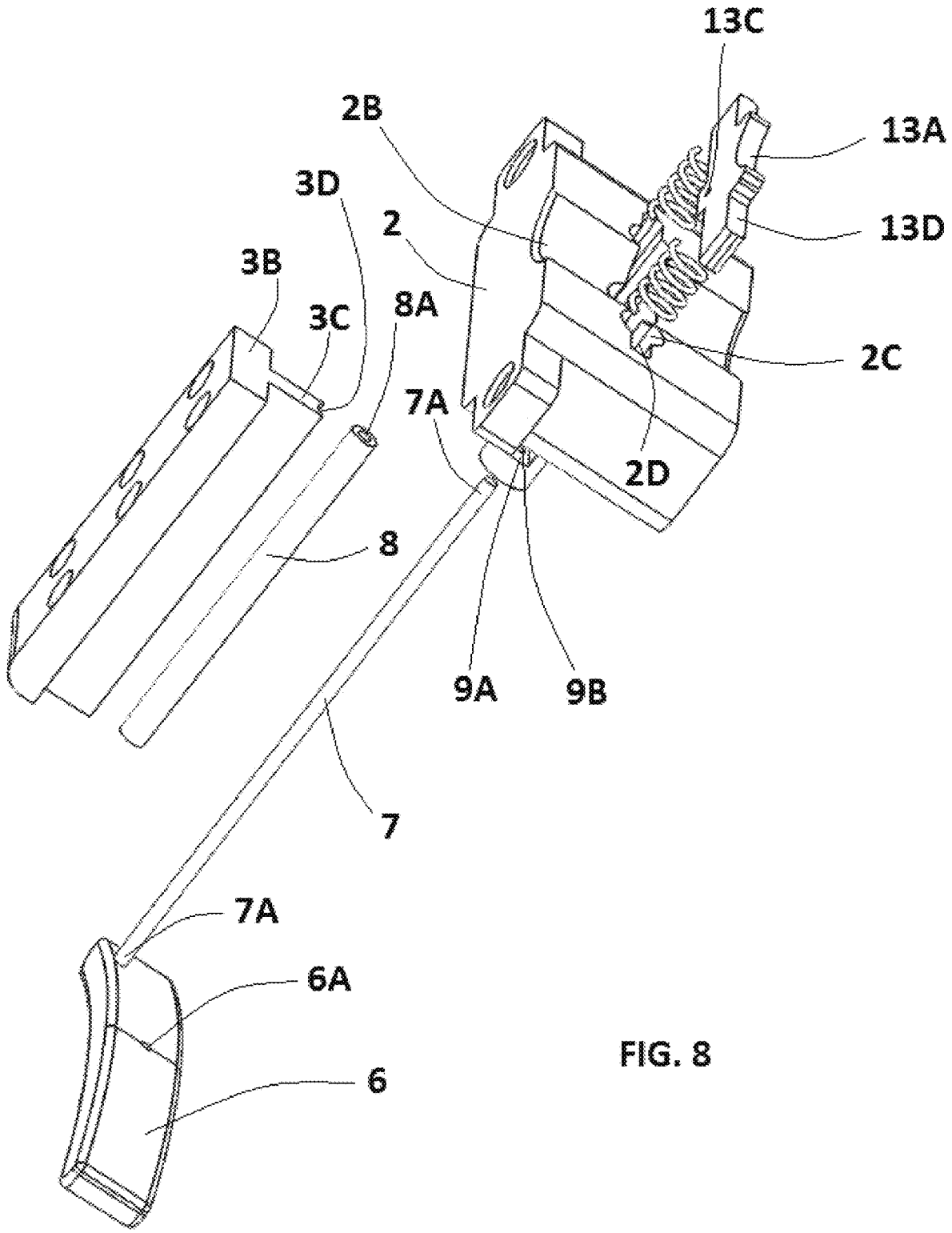
FIG. 8 is an exploded view of the release and lock pull lever and associated structures used in a weight plate of the present invention.

A lock plate plug 9 is provided, and receives the pull rod 7 within the lock assembly case 2, as seen in several of the figures, including FIGS. 6 and 7. The lock plate plug 9 includes a mounting slot 9A, an attachment pinhole 9B, and a threaded mounting hole 9C to facilitate the connection between the lock plate 13 in the lock assembly case 2 and the pull rod 7.

With reference to the lock plate 13, this component is spring mounted with respect to the lock assembly case 2, and may be moved up and down within the lock assembly case 2 by alternatively pulling upon, and releasing, the pull lever 6. The lock plate 13 includes an arced contact surface 13A, a mounting tab 13B and an attachment pinhole 13C. The mounting tab 13B of the lock plate 13 is received within the mounting slot 9A of the lock plate plug 9, and the two are connected by inserting an appropriate pin through the attachment pinhole 9B, and the attachment pinhole 13C.

The lock plate 13 further incorporates an upper contact stop pad 13D and a lower contact stop pad 13E.

In operation, the weight plate 1 of the invention facilitates for a quick and effective connection between the weight plate 1 and the barbell 19, in a self-contained manner, whereby external tools or other hardware are not required for the connection.

The user would hold the weight plate 1 in two of the available hand space 5 areas, utilizing the handles 4 in the chosen hand space area, as necessary or comfortable, and with the fingers pull up on the release and lock pull lever 6 that resides in one of the available hand space areas. By raising the release and lock pull lever 6, the lock plate 13 is raised, since the release and lock pull lever 6 and the lock plate 13 are connected to each other by means of the pull rod 7. When the release and lock pull lever 6 and lock plate 13 are raised, against the bias of the springs 10, the arced contact surface 13B is moved to allow clearance of the weight plate center bar mounting hole 1A, which allows for area 22 of the barbell 19 to be received without obstruction, and the weight plate 1 can be slid along the area 22 of the barbell 19 until the user determines that the weight plate 1 has reached a lock groove 23, which represents a suitable location for fixing the weight plate 1 to the barbell 19. At this point, the release and lock pull lever 6 is released, and the force of the springs 10 once again move the lock plate 13 and its associated contact surface 13A into the lock groove 23 of holding bar area 22 and then facilitated by the user a slight rotational spin of the weight plate 1 until the lock plate 13 secondarily engages the alignment groove 24 within the lock groove 23. The contact surface 13A is received within the lock groove 23, thereby securing the weight plate 1 on the barbell 19 so that it cannot move axially up and down the barbell 19 and further secured rotationally once the lock plate surface 13A is engaged in the alignment groove 24 within the area 22 of the barbell 19. When the user wishes to remove the weight plate 1, the reverse operation is carried out. Thus, the release and lock pull a lever 6 is pulled so that the lock plate 13 and contact surface 13A move out of the alignment groove 24 and lock groove 23, and the weight plate 1 can thereafter slide off the area 22 of the barbell 19, for easy removal.

The pull rod 7 is generally held in a secure manner within the pull rod tube 8, which is in turn securely held by the pull rod casing 3, providing a strong and efficient guide for the pull rod 7, and able to deal with the continuous forces to which it may be subjected.

Figure 9:
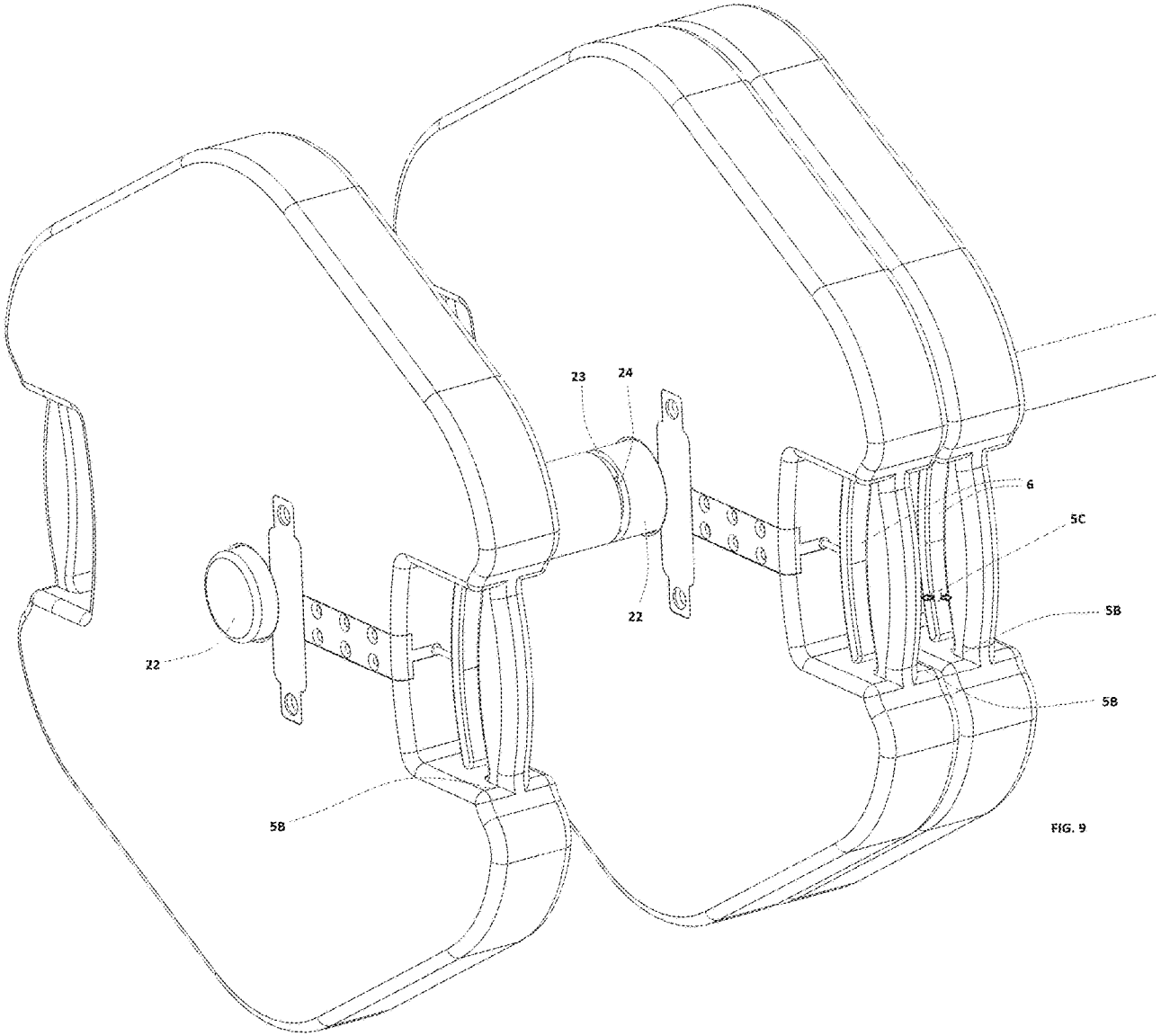
FIG. 9 is a perspective view which shows several weight plates mounted on a barbell in accordance with the present invention.
Figure 10:
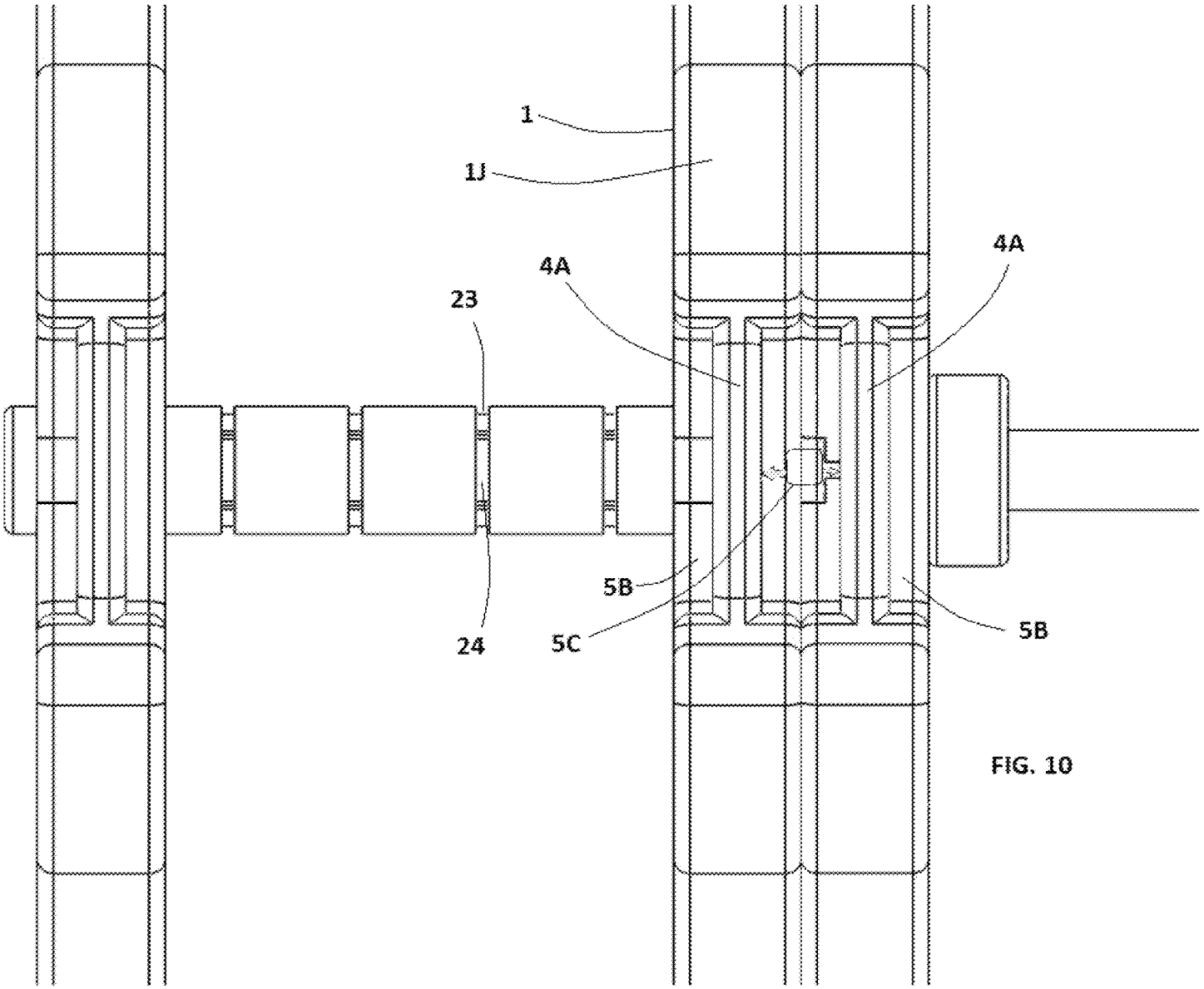
FIG. 10 is a detailed side angle view showing several weight plates mounted on a barbell in accordance with the invention.

FIGS. 9 and 10 of the drawings show several weight plates mounted on a barbell 19. Preferably, the lock grooves 23 are spaced so that weight plates 1, which have the weight plate outer edge 1J, can be connected to the barbell 19 in a manner such that the weight plates 1 are right up against each other. However, other configurations may be used. Further, it will be appreciated from observing FIG. 9 of the drawings that the hand space 5 and release and lock pull lever 6 are constructed into the weight plate 1 so that they are always easily accessible using the fingers, and that plenty of finger space is provided additionally by the recessed area 5B which reduces the thickness of the handle 4 while when aligned against additional plates creates finger space so that the user will not find the space 5 cramped or uncomfortably small when it comes to grabbing the pull lever 6 for removing a weight plate 1 from the barbell 19, especially when the weight plates 1 abut up against each other. In FIGS. 9 and 10, space relief 5B indicates the reduced thickness of the weight plate 1 at the handle access location adjacent the handle 4 and FIG. 5C shows that when the weight plates are locked in place and aligned by utilizing the alignment groove 24 engaged with the lock plate 13 the hand access space to grasp the handle 4 and the pull handle 6 is sufficiently spacious.

Figure 11:
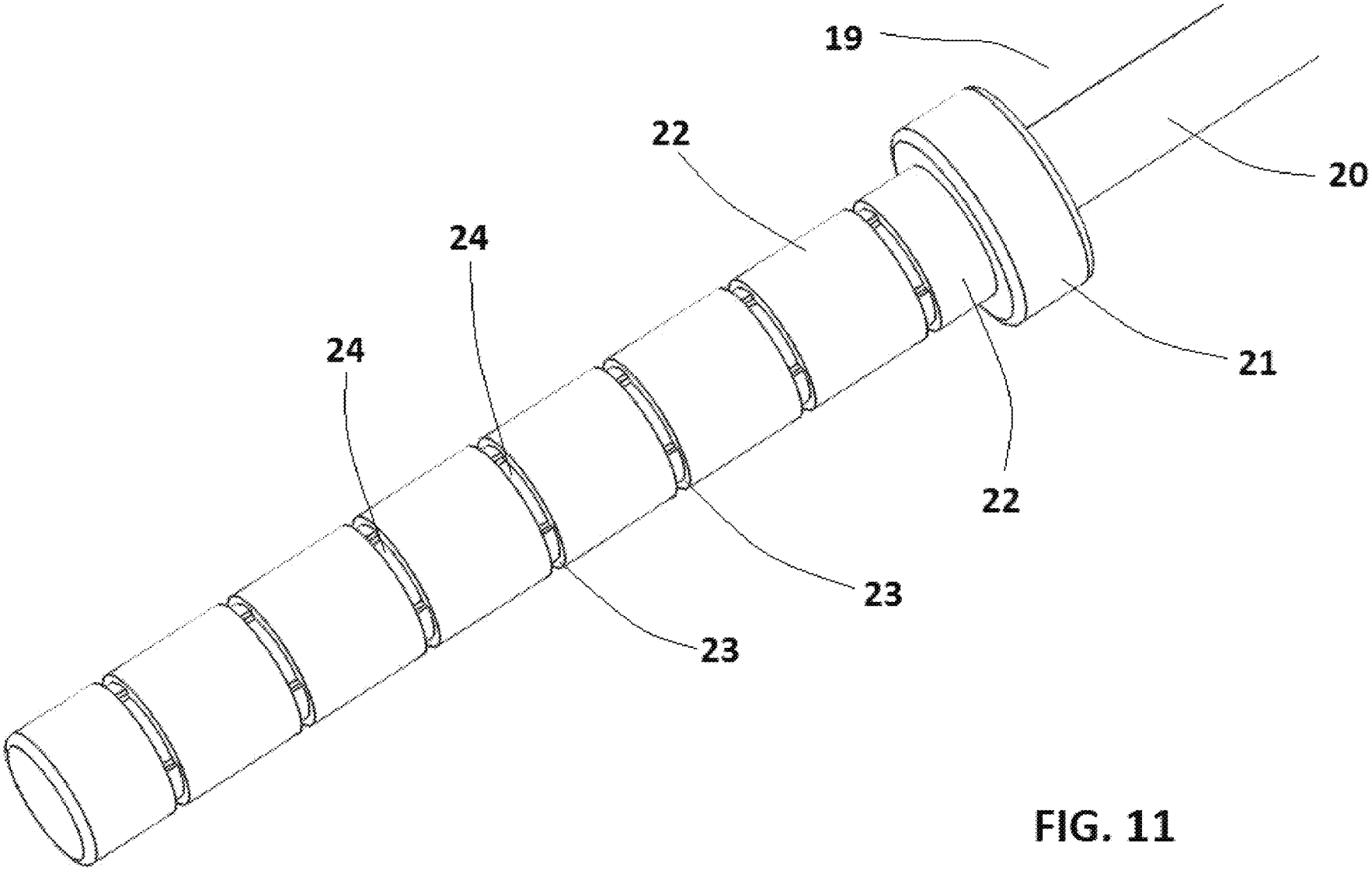
FIG. 11 is a detail perspective view of a barbell in accordance with the current invention.

FIG. 11 of the drawings also shows in further detail an important feature of the invention, namely, the alignment lock groove 24 formed within the lock groove 23 of area 22 of the weight bar 19. It will be appreciated that the presence of the lock plate 13 within the lock groove 23 will prevent movement of the weight plate 1 axially along the barbell 19. However, when the arced lock plate contact surface 13A is received within the alignment lock groove 24, the weight plate 1 will also be prevented from rotational movement about the barbell 19. Thus, the structure of the lock groove 23 with the alignment lock groove 24, and its interaction with the lock plate 13 and contact surface 13A essentially fix the weight plate 1 on the barbell 19, restricting both axial and rotational movement between these two components relative to each other.

Figure 12:
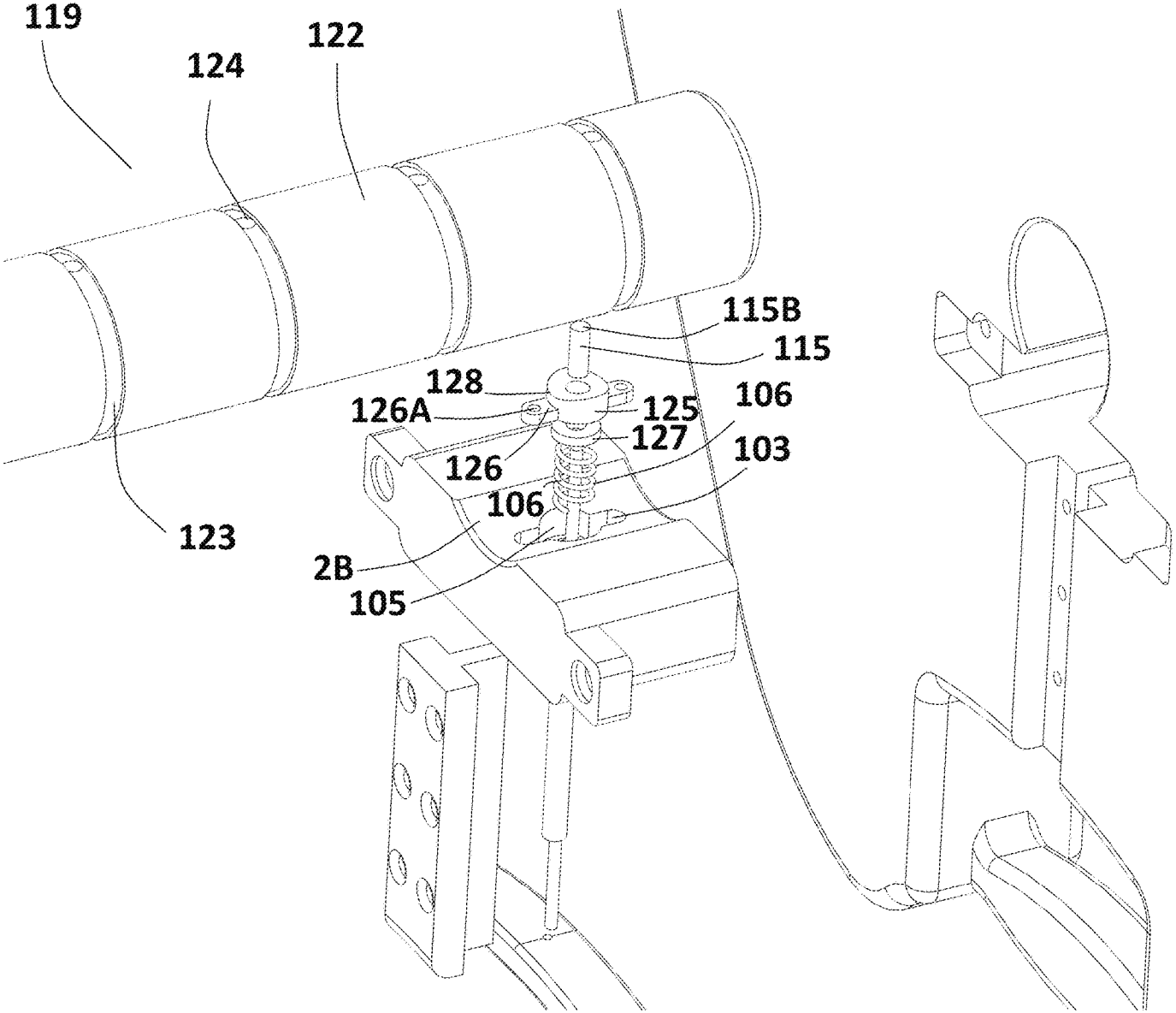
FIG. 12 is a detailed view showing a form of connection in accordance with a further embodiment of the invention.
Figure 13:
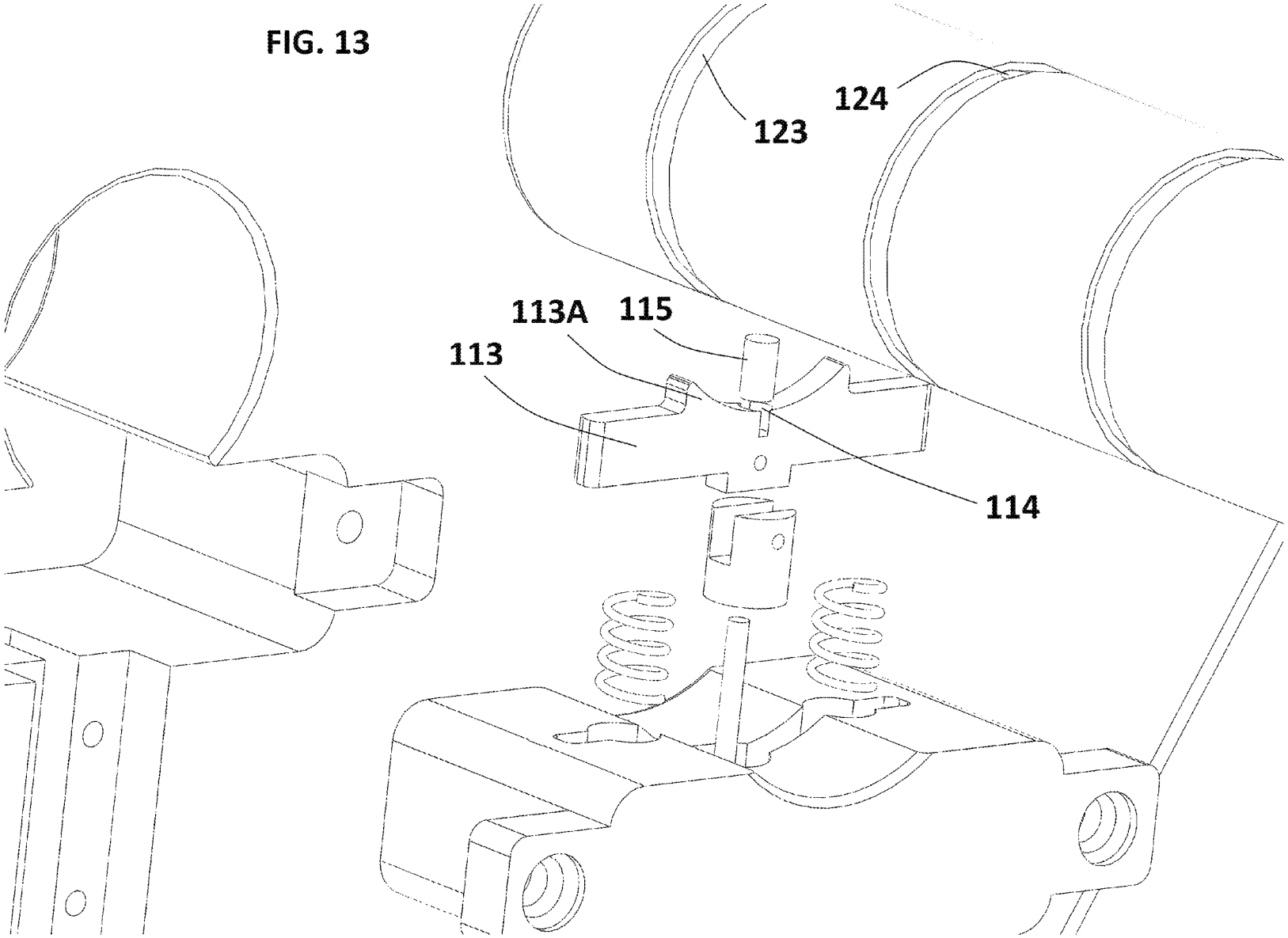
FIG. 13 is an inverted detail showing the lock assembly case and associated structures in accordance with the embodiment of the invention as shown in FIG. 12.
Figure 14:
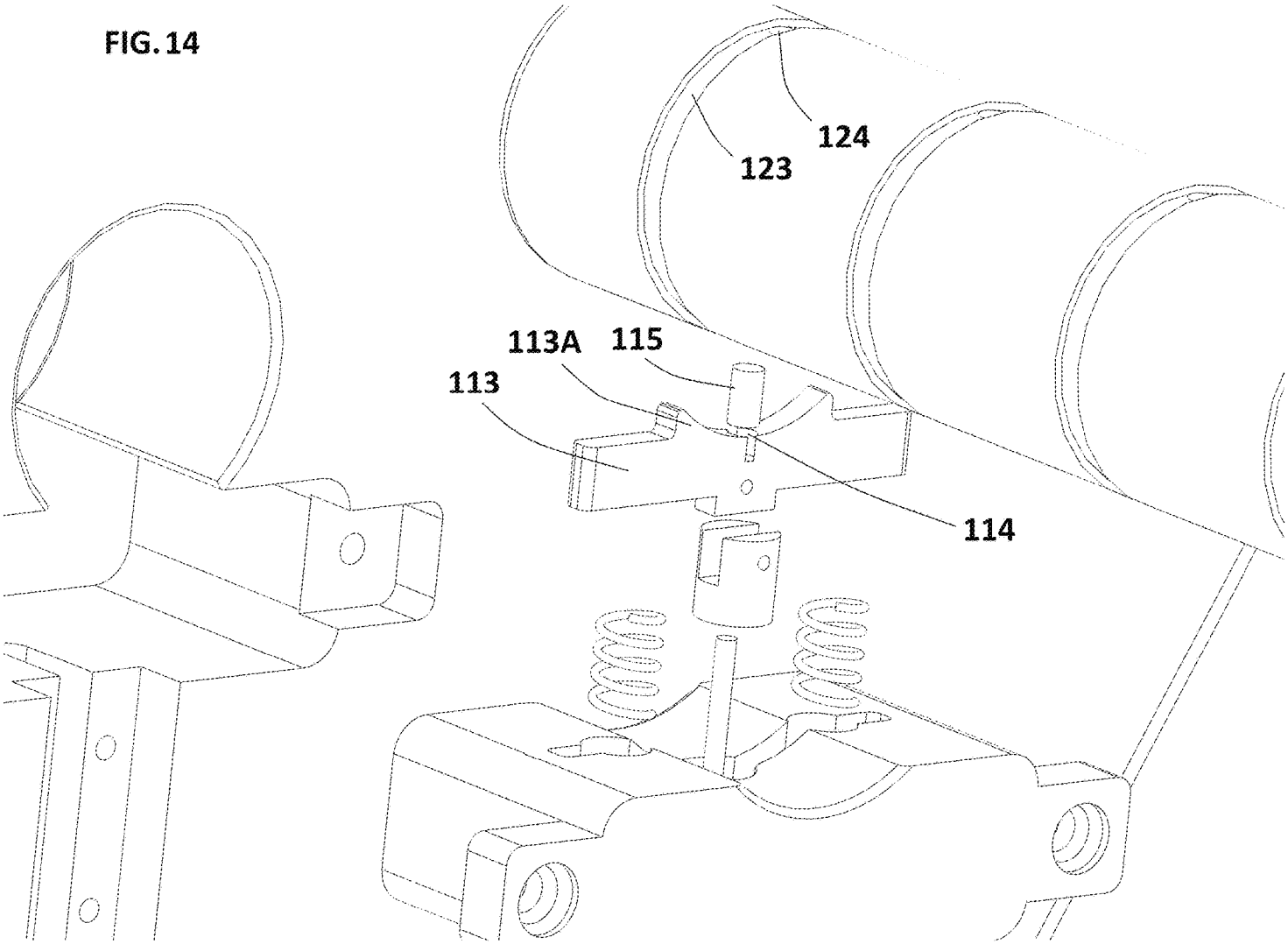
FIG. 14 is a detailed perspective view showing yet a further form of connection in accordance with an embodiment of the invention.

Reference is now made to FIGS. 12, 13 and 14 which show different features and embodiments of a weight plate in accordance with the present invention. With respect to these figures, the description herein will refer to the additions or differences, and will not repeat or describe the common features.

FIG. 12 of the drawings illustrates a detail of a further embodiment including a lock assembly barbell clearance arc 2B. The lock assembly 2 in this figure, and associated components, includes a spring retainer block wing recess area 103 and a spring retainer block recess area 105. A spring 106 fits within the recess area 105. A spring retainer block 125 is received within the recess area 105 and each of a pair of spring retainer block wings 126 are received within the block wing recess area 103 respectively. This figure also illustrates the barbell 122, which includes the barbell alignment groove 123, and a barbell alignment pin hole 124 located within the alignment groove 123.

A lock assembly alignment pin 115 is received within the spring retainer block clearance arc 2B. The alignment pin 115 includes an alignment pin insertion end 115B. Each of the spring retainer block wings 126 includes a mounting hole 126A, and a spring retainer washer 127 is provided, which is located between the spring 106 and the spring retainer block 125.

In this embodiment shown in FIGS. 12 and 13, the weight plate is mounted on the barbell in a manner similar to that discussed and described above, and a secure connection between the two is effected when the alignment pin 115 is received within the alignment pin hole 124 formed in the lock groove 123 of area 122 of the barbell 119. Note that the alignment pin 115 can be moved axially up and down, and consequentially toward and away from the area 122 barbell 119. Such action would be operated by appropriate movement of the pull lever or its equivalent described in an earlier embodiment. The positioning of the alignment pin 115 within the alignment pin hole 124 effectively secures the weight plates to the barbell, and at the same time prevents any axial or rotational movement of the weight plate about the barbell by engaging both the lock groove 123 and the alignment hole 124.

FIG. 13 of the drawings shows a further inverted detail of FIG. 12 including the pull rod 7 sleeved within the pull rod tube 8. The lock assembly case 102 is shown, including the barbell clearance arc 102B. The structure includes a spring retainer block wing recess area 103, including the retainer block fastening holes 104 and a block recess area 105. The block recess area 105 has an internal spring contact surface 105A, and a spring 106 is positioned on the pull rod 7, and resides between the contact surface 105A and spring retainer washer 127 which is fastened in place by the spring retainer block 125.

FIG. 14 of the drawings shows a further embodiment including a lock plate 113 having a reduced height arced contact surface 113A compared to one described in a previous embodiment. A lock assembly alignment pin 115 is received within an alignment pin engagement recess 114 in the lock plate 113. The structure connects to a barbell which includes a lock groove 123 and an alignment pin hole 124. The arced contact surface 113A is releasably and selectively received within the alignment groove 123, fixing the weight plate axially on the barbell. The weight plate may then be rotated about the barbell until the alignment pin 115 reaches the circumferential position of the alignment pin hole 124, snapping into the alignment pin hole 124 and therefore preventing any further rotational movement of the weight plate about the barbell while additionally facilitating the alignment of hand hold areas of additional weight plates that may already be locked on the barbell.

Figure 15:
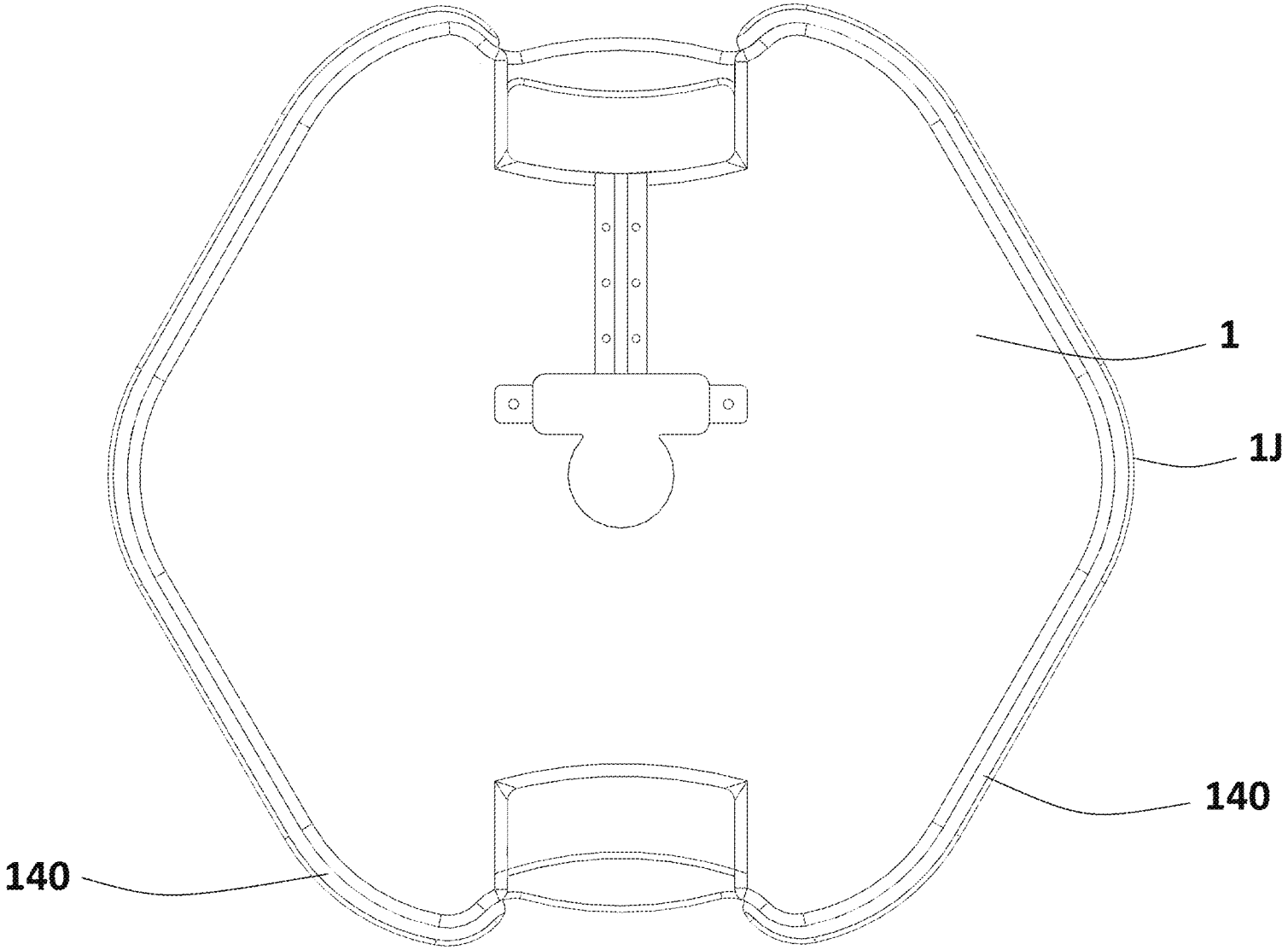
FIG. 15 is a front view of a weight plate in accordance with an embodiment of the invention.

Reference is now made to FIG. 15 of the drawings which shows a weight plate 1 in accordance with a further embodiment of the invention. In this embodiment, the weight plate 1 has a weight plate edge surface 1J, to which is attached or affixed an edge bumper strip 140. The bumper strip 140 may be permanently attached to the weight plate 1, or it may be releasably attached so that it can be removed for maintenance, repair, replacement or the like.

Figure 16:
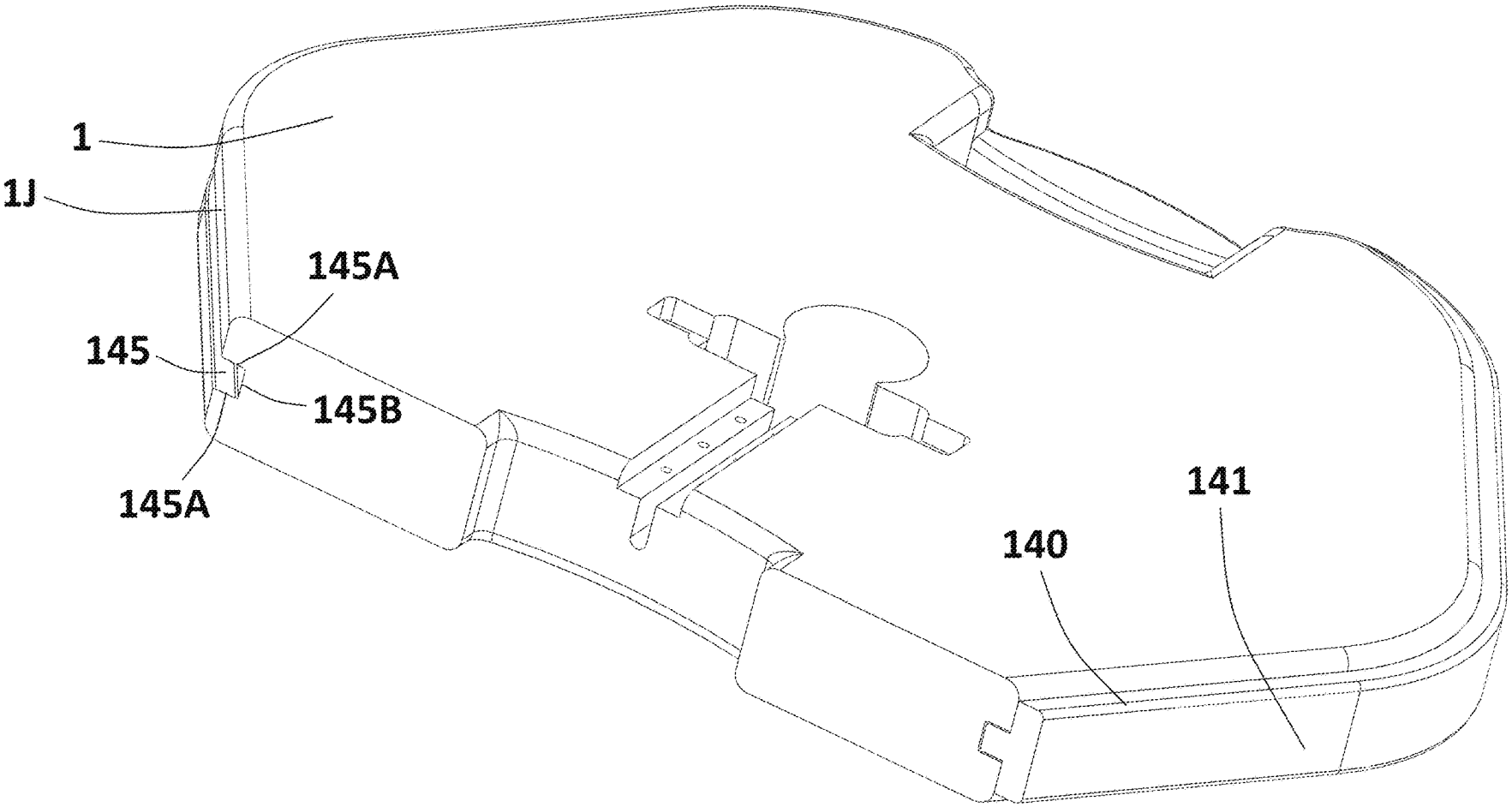
FIG. 16 is a side perspective view of a weight plate in accordance with an embodiment of the invention.

FIG. 16 of the drawings illustrates a weight plate 1 of the type shown in FIG. 15 of the drawings from a side perspective view. The weight plate 1 includes the weight plate edge surface 1J and the edge bumper strip 140. The edge bumper strip 140 has an edge bumper band top surface 141. A receiving slot 145 is provided on the weight plate edge surface 1J for the edge bumper strip 140. The receiving slot 145 includes a side mounting surface for the edge strip 145A and a bottom mounting surface for the edge strip 145B.

Figure 17:
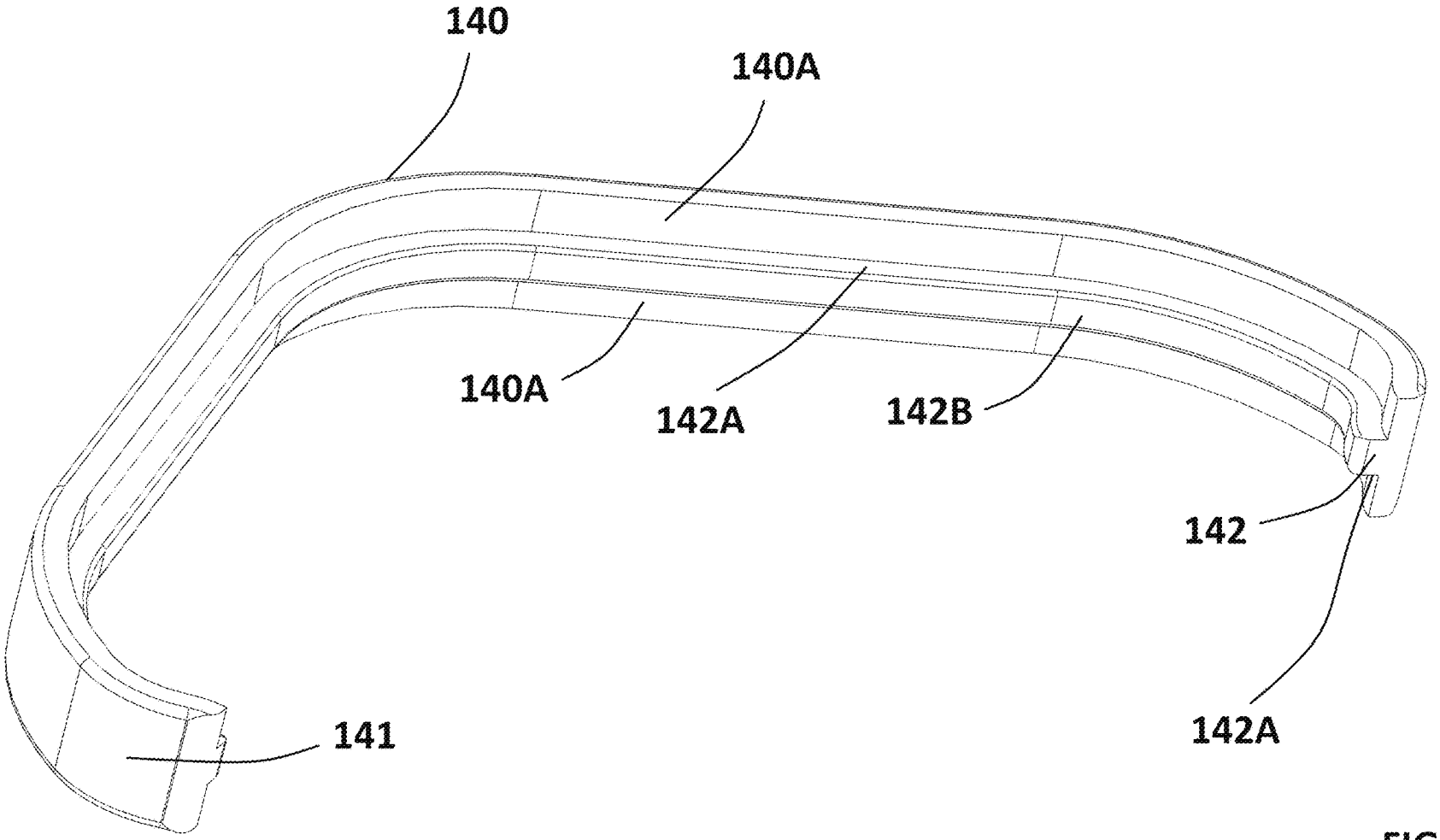
FIG. 17 is detail perspective view of a bumper strip used with a weight plate in accordance with one aspect of the invention.

FIG. 17 of the drawings shows a detailed perspective view of the edge bumper strip 140, illustrating its structure and components. The edge bumper strip 140 includes an edge bumper strip mounting surface 140A. The edge bumper band top surface 141 comprises an edge bumper band vertical leg 142, which has side mounting surfaces 142A, as well as a bottom mounting surface 142B. The edge bumper band vertical leg 142 is snugly received within the receiving slot 145, and when so received, the edge bumper strip mounting surface 140A will be in contact with the weight plate outer edge 1J. It is to be noted that the edge bumper strip 140 may have alternative or additional types of attachment mechanisms for securing it to the weight plate 1.

Figure 18:
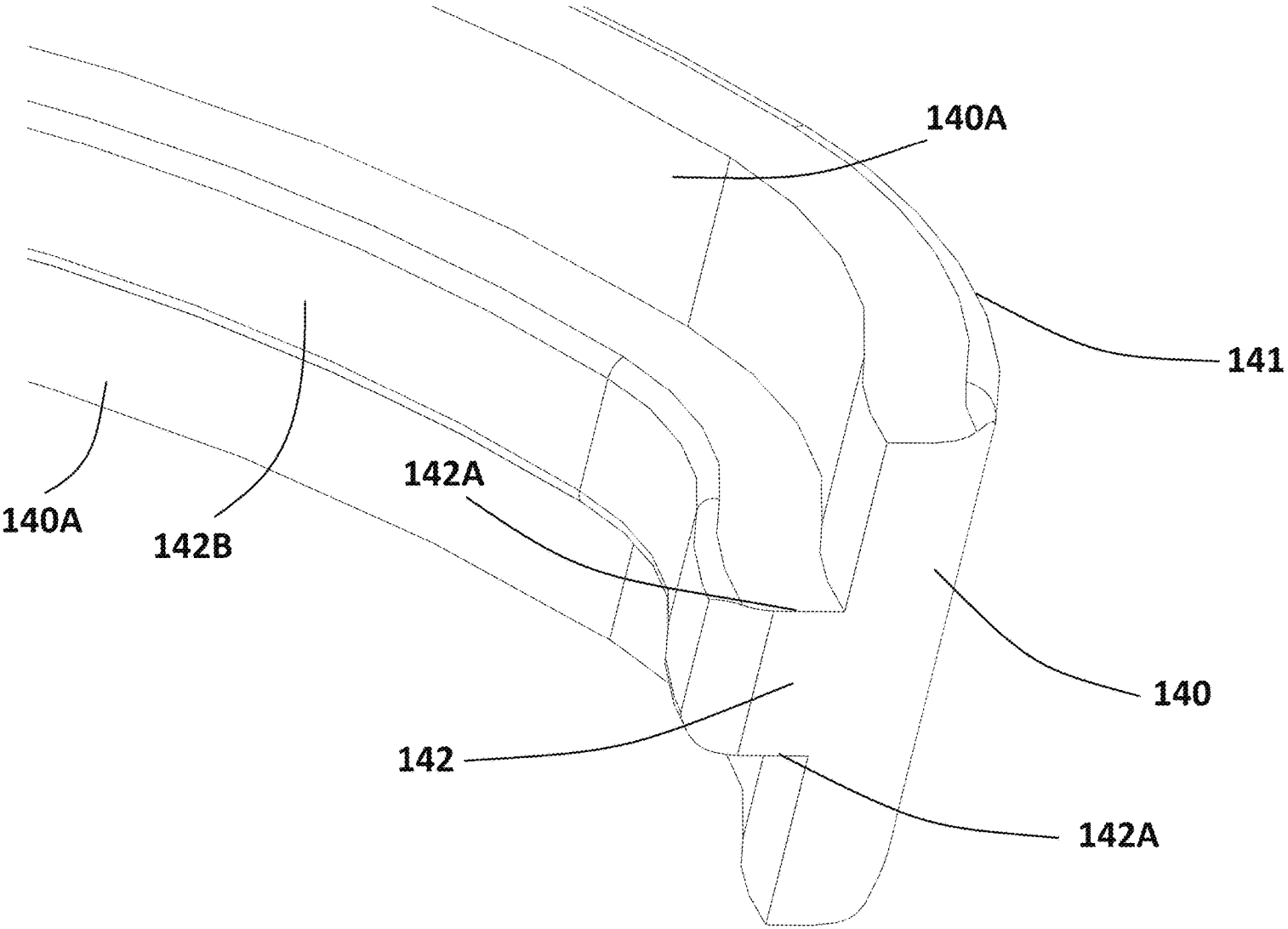
FIG. 18 is a detail of a portion of a bumper strip which can be used in accordance with the invention.

FIG. 18 of the drawings shows a more detailed representation of the edge bumper strip 140 in accordance with the present invention. There is clearly seen in this figure the presence of the edge bumper strip mounting surface 140A, as well as the edge bumper band top surface 141 and the edge bumper band vertical leg 142. Also clearly illustrated is the side mounting surface 142A of the edge bumper band vertical leg 142, and the bottom mounting surface 142B of the edge bumper band vertical leg 142.

The presence of the edge bumper strip 140 may provide certain advantages and benefits to the weight plate 1 of the invention. For one thing, it may provide a removable and replaceable protective edge for the weight plate, and further offer a softer or somewhat cushioned outer surface as opposed to the hardness of the metal or other material of which the weight plate one may be comprised.

The edge bumper strip 140 may also come in different colors, thicknesses and dimensions. In this way, a particular weight plate 1 maybe color coded for easy identification and classification. Any number of colors may be used. In an example, a 25 pound weight may have an orange edge bumper strip 140, so that a person seeking such a weight can easily identify it without having to resort to reading off numbers which are not always immediately and clearly visible. The edge bumper strip 140 may also facilitate noise abatement when the weight is placed on a surface, with the bumper strip 140 providing a cushion to produce a potentially more muffled sound, as opposed to a strident clang produced when hard materials collide.

The embodiments described herein represent various aspects of the invention, but structural changes may be made so as to provide a weight plate still falling within the scope of the invention.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A barbell and weight plate engagement system comprising:

a substantially tubular barbell, and a generally disk shaped weight plate, the barbell having a longer middle section and a shorter end section at both ends of the longer middle section, the shorter end sections each having a plurality of spaced apart lock grooves cut around the entirety of an outer surface of the barbell, each lock groove further comprising an alignment groove;

the disk-shaped weight plate having a central aperture and a plurality of peripheral handles, the central aperture for receiving one of the shorter end sections of the barbell, and a fastening assembly mounted within the weight plate comprising a pull rod with a lock plate fixed at one end and a lock pull lever fixed at the other, the lock plate aligned to engage in the central aperture, the lock pull lever aligned within at least one of the peripheral handles and moving the lock plate between a first position in which the lock plate engages one of the plurality of spaced apart lock grooves and the alignment groove on the barbell and a second position in which the lock plate disengages from the lock groove and the alignment groove on the barbell.

2. The barbell and weight plate engagement system as claimed in claim 1 wherein down and up movement of the lock pull lever moves the lock plate between the first position in which it engages with the lock groove and the alignment groove and the second position in which the lock plate is disengaged from the lock groove and alignment groove on the barbell.

3. The barbell and weight plate engagement system as claimed in claim 2 further comprising a lock assembly case fixed relative to the weight plate, the lock assembly case accommodating the lock plate, lock plate plug, the pull rod, and springs, and further supporting the fastening assembly's transition from the first position to the second position and back to the first position in response to the pull lever.

4. The barbell and weight plate engagement system as claimed in claim 3, further comprising a pull rod tube in which the pull rod is positioned and is capable of up and down movement therein.

5. The barbell and weight plate engagement system as claimed in claim 3 further comprising a pull rod casing extending between the lock assembly case and a hand space opening in the peripheral handle wherein the lock pull lever resides, the pull rod casing housing a pull rod tube.

6. The barbell and weight plate engagement system as claimed in claim 2 further comprising a spring that maintains the lock plate into the first position.

7. The barbell and weight plate engagement system as claimed in claim 2, wherein the weight plate's lock plate comprises an arced contact surface which engages a circumferential lock groove and the alignment groove formed within the circumferential lock groove formed in the barbell, the arced contact surface being releasably accommodated within the alignment groove.

8. The barbell and weight plate engagement system as claimed in claim 1 wherein a plurality of said generally disk shaped weight plates selectively mounted on the barbell lock axially and rotationally and further are aligned rotationally to allow the peripheral handles to align affording sufficient space between the weight plates only at the peripheral handles for access to a user to operate engagement and disengagement of the lock plate from the barbell via the lock pull lever.

9. The barbell and weight plate engagement system as claimed in claim 8 wherein the peripheral handles on one of said plurality of weight plates are of reduced thickness to provide access to fingers of the user when the weight plate is locked and aligned on the barbell and directly adjacent one or more other weight plates of said plurality of weight plates that are also locked and aligned on the barbell.

10. The barbell and weight plate engagement system as claimed in claim 1 further comprising an edge bumper strip mounted on an outer edge of the weight plate.

11. The barbell and weight plate engagement system as claimed in claim 10 wherein the edge bumper strip is color-coded so as to identify a selected weight plate.

12. The barbell and weight plate engagement system as claimed in claim 1, wherein at least one of the plurality of lock grooves formed on the barbell further comprises an alignment groove therein, each lock groove and alignment lock groove in combination restricting both axial and rotational movement of the weight plate relative to the barbell.

13. The barbell and weight plate engagement system as claimed in claim 1 wherein the fastening assembly includes an alignment pin, the barbell comprising each lock groove including at least one alignment pinhole formed within the lock groove, the alignment pin on the fastening assembly being selectively receivable within the alignment pinhole to secure the weight plate to the barbell in a manner which prevents axial and rotational movement of the weight plate relative to the barbell.

14. The barbell and weight plate engagement system as claimed in claim 1, wherein the weight plate when not in use resides with the fastening assembly in the first position due to internal springs applying pressure to the lock plate holding that position, to attach the weight plate to the barbell the lock plate must be moved from the first position, to the second position being disengaged to clear the lock plate from the central aperture via the lock pull lever allowing the barbell to enter the central aperture, once the barbell has entered the weight plate central aperture the lock pull lever is configured to be released allowing the lock plate to engage the lock groove and the alignment groove on the barbell.

* * * * *